US012800197B2

(12) United States Patent
Durand et al.

(10) Patent No.: US 12,800,197 B2
(45) Date of Patent: Nov. 17, 2026

(54) FLUID CIRCULATION DEVICE, INSTALLATION AND METHOD USING SUCH A DEVICE

(71) Applicant: L'Air Liquide, Societe Anonyme pour l'Etude et l'Exploitation des Procedes Georges Claude, Paris (FR)

(72) Inventors: Fabien Durand, Sassenage (FR); Pierre Adrien Gond, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 172 days.

(21) Appl. No.: 18/845,595

(22) PCT Filed: Dec. 7, 2022

(86) PCT No.: PCT/EP2022/084801
§ 371 (c)(1),
(2) Date: Sep. 10, 2024

(87) PCT Pub. No.: WO2023/169709
PCT Pub. Date: Sep. 14, 2023

(65) Prior Publication Data

US 2025/0189184 A1 Jun. 12, 2025

(30) Foreign Application Priority Data

Mar. 10, 2022 (FR) ..... 2202099

(51) Int. Cl.
*F25B 31/00* (2006.01)
*F25B 9/06* (2006.01)
*F25B 49/02* (2006.01)

(52) U.S. Cl.
CPC ..... *F25B 31/006* (2013.01); *F25B 9/06* (2013.01); *F25B 49/025* (2013.01); *F25B 2400/077* (2013.01)

(58) Field of Classification Search
CPC ..... F25B 31/006; F25B 9/06; F25B 49/025; F25B 2400/077
See application file for complete search history.

(56) References Cited

U.S. PATENT DOCUMENTS

2009/0090113 A1* 4/2009 Caillat ..... F04D 29/5813 417/213
2009/0090118 A1 4/2009 Pham et al.
2022/0104391 A1* 3/2022 Lakhkar ..... H05K 7/20145

FOREIGN PATENT DOCUMENTS

EP 0 933 603 8/1999
JP H10 292 948 11/1998

OTHER PUBLICATIONS

International Search Report and Written Opinion for PCT/EP2022/084801, mailed Mar. 27, 2023.
French Search Report for FR 2 202 099, mailed Oct. 12, 2022.

* cited by examiner

*Primary Examiner* — Elizabeth J Martin
(74) *Attorney, Agent, or Firm* — Justin K. Murray

(57) ABSTRACT

An installation for providing cooling includes a fluid circuit having a first pressure and a second pressure higher than the first pressure. A first drive unit comprises a compressor wheel forming a compression stage for the fluid circuit. A junction box is configured to house electrical circuitry. A conveying duct fluidly connects a portion of the fluid circuit to an interior of the junction box to collect a fraction of fluid from the fluid circuit. The conveying duct circulates the collected fraction of the fluid within the interior of the junction box to cool the junction box. A return duct fluidly (Continued)

connects the interior of the junction box to the fluid circuit to return the fraction of the fluid back to the fluid circuit.

18 Claims, 5 Drawing Sheets

[Fig. 1]
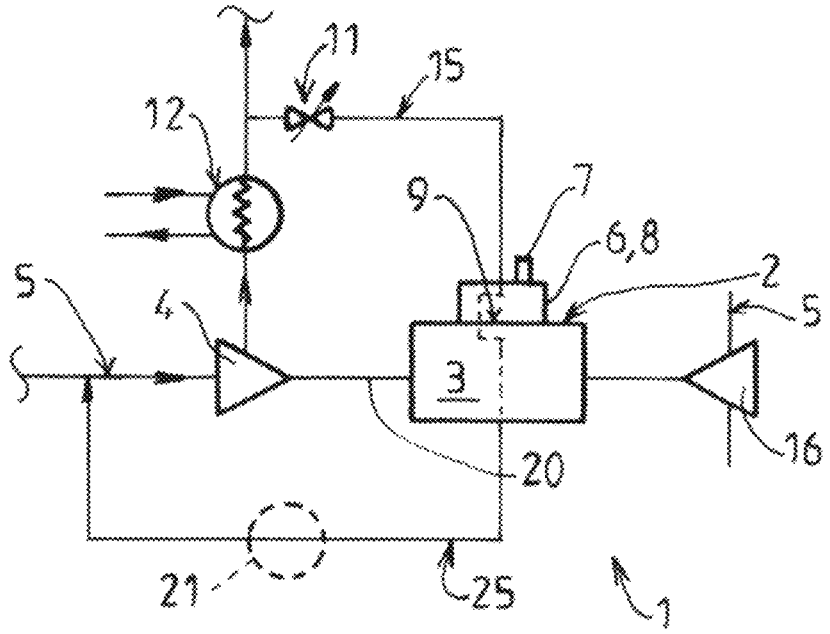
[Fig. 2]
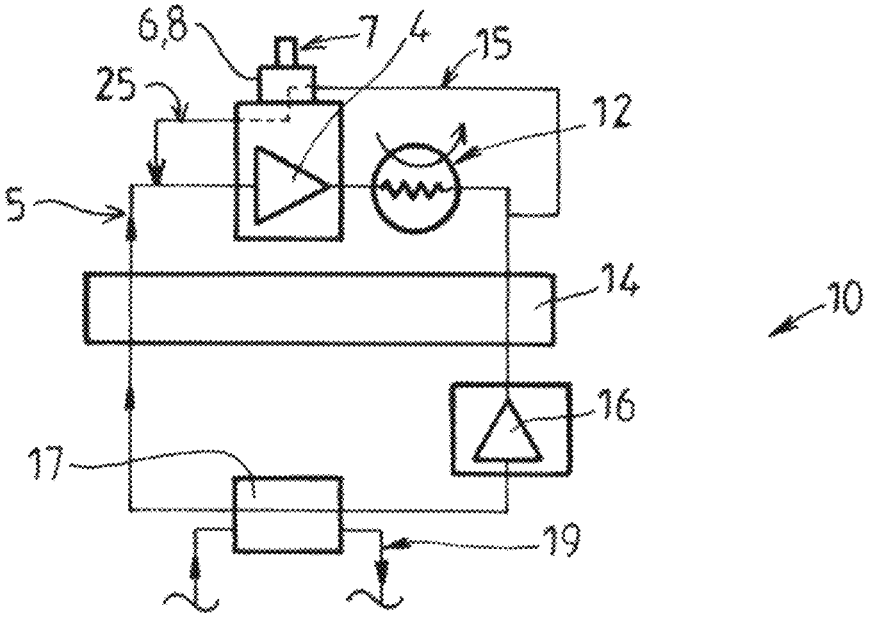

[Fig. 3]
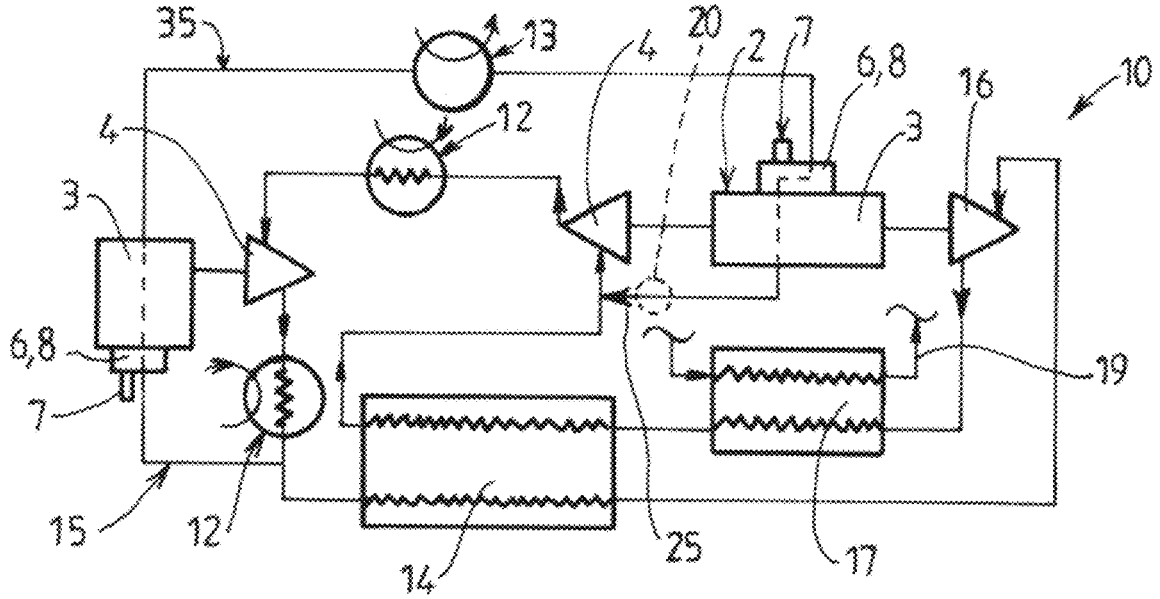
[Fig. 4]
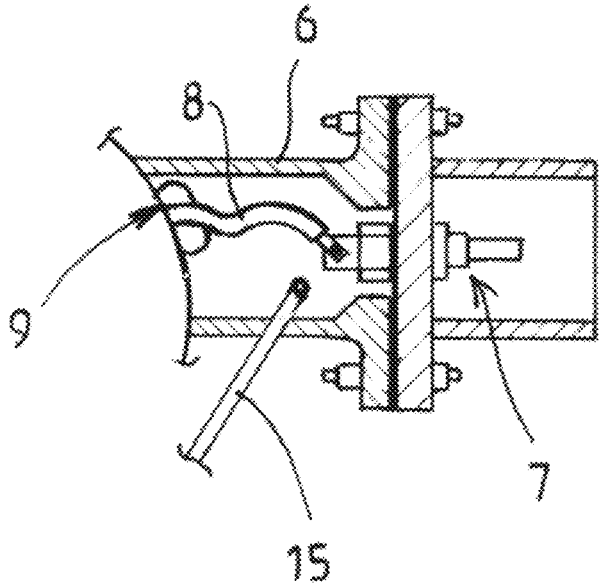

[Fig. 5]
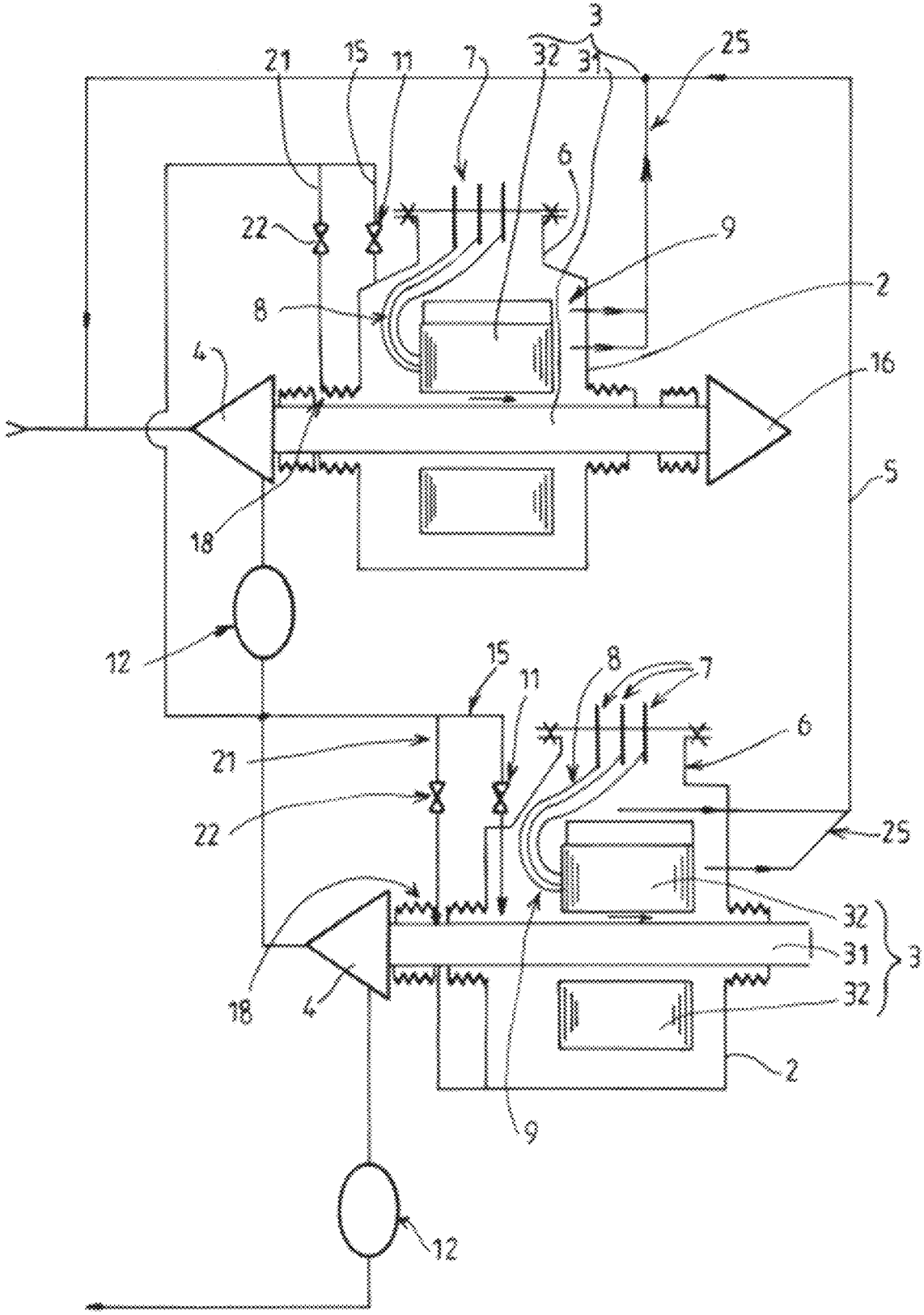

[Fig. 6]
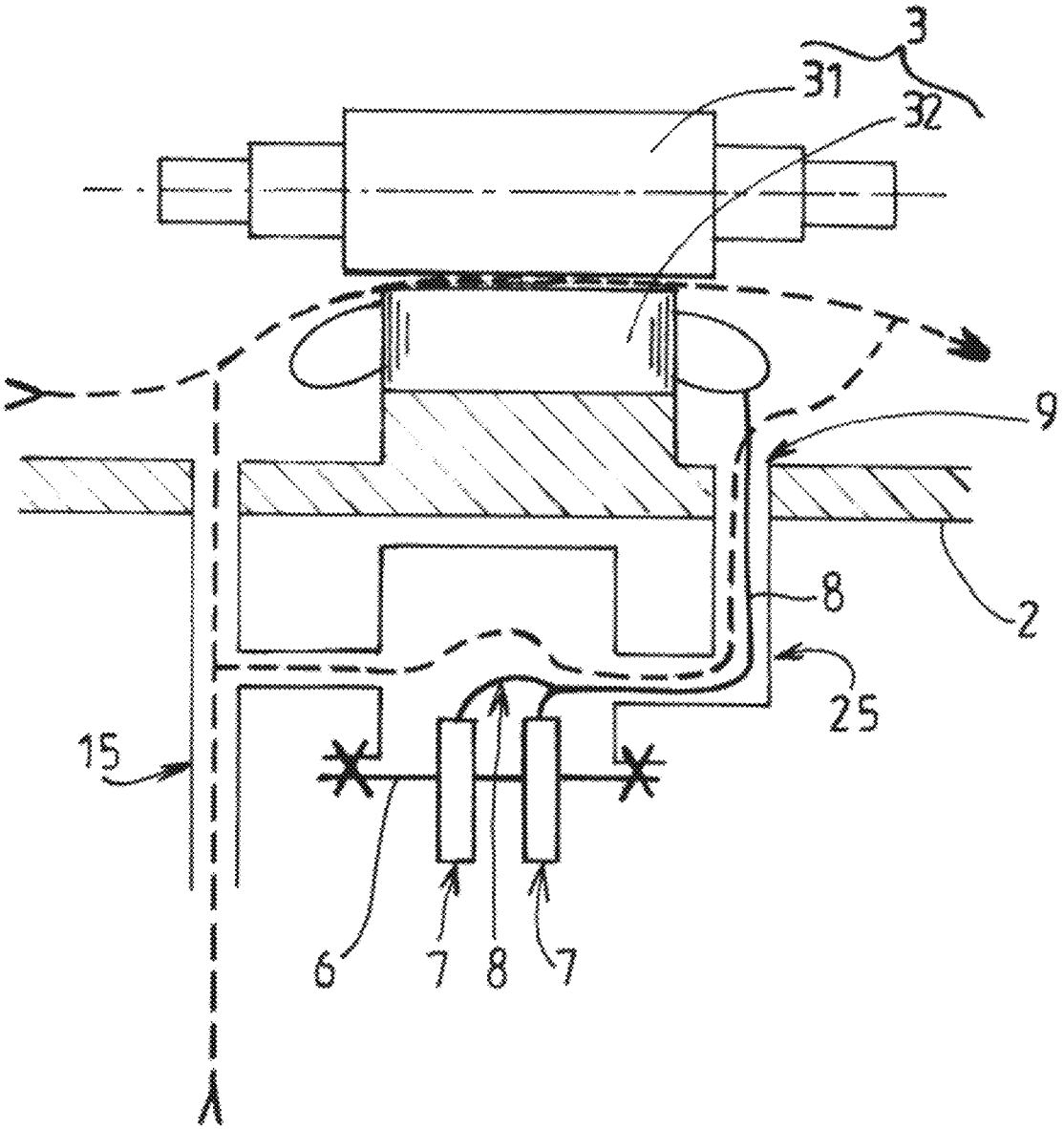

[Fig. 7]
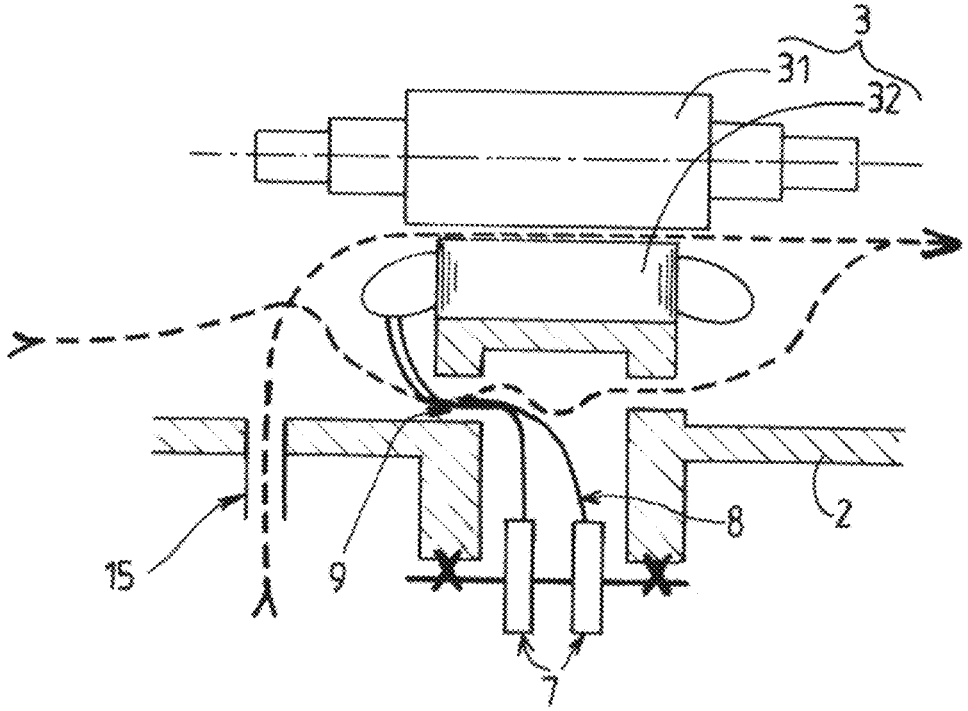
[Fig. 8]
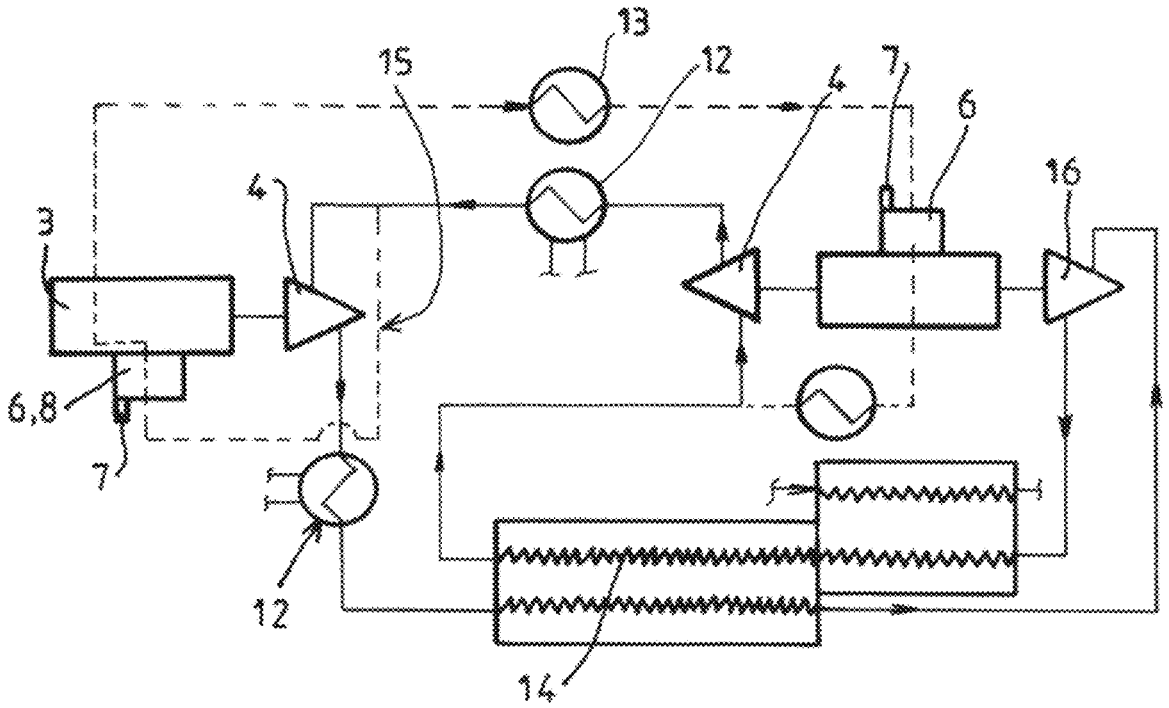

FLUID CIRCULATION DEVICE, INSTALLATION AND METHOD USING SUCH A DEVICE

CROSS REFERENCE TO RELATED APPLICATIONS

This application is a § 371 of International PCT Application PCT/EP2022/084801, filed Dec. 7, 2022, which claims the benefit of FR2202099, filed Mar. 10, 2022, both of which are herein incorporated by reference in their entireties.

FIELD OF THE INVENTION

The invention concerns a fluid circulation device as well as an installation and a method using such a device.

More particularly, the invention concerns a fluid circulation device, in particular for a refrigerator or cryogenic liquefier, comprising a casing which is sealed against the exterior of the device, and contains an electrical machine such as an electric motor or an alternator, the device comprising a cycle gas circuit which subjects the cycle gas to a thermodynamic change between a minimal pressure and a maximal pressure when the device is operating, the device comprising at least one unit to drive the cycle gas in the circuit, such as a compressor wheel, said drive unit being coupled in rotation to the electrical machine, the device comprising an electrical junction box which is sealed against the exterior of the device, and in which there passes electrical circuitry having a first end connected to the electrical machine, and a second end connected to at least one electrical connector which opens onto the exterior of the junction box, and is situated on the exterior of the casing.

BACKGROUND OF THE INVENTION

In particular, the invention concerns a system for cooling an electrical junction box of an electric motor by a cycle gas flow.

In fact, it can be necessary to cool the electrical supply enclosure (junction box) of an electric motor or turbomachine.

This junction box is often spaced from the gas circulation or the cooling water radiator of the central part of the associated motor or turbomachine.

In known solutions, this box is cooled by natural convection, by conduction by the walls of the junction box. In addition, the heat is controlled by dimensioning of the junction box, and increase of its surface area in contact with the ambient temperature, of the diameter of the cables, and of the size of the spark plugs or electrical connectors. These measures increase the global size of the junction box, its weight, its production cost, and the risks of leakage.

In addition, as a result of its capacity to retain the pressure, the thickness of the walls of a box of this type limits its cooling by conduction.

SUMMARY OF THE INVENTION

An objective of the present invention is to eliminate some or all of the disadvantages of the prior art indicated above.

In an effort to overcome the deficiencies of the prior art discussed, supra, the device according to certain embodiments of the invention, which is moreover in conformity with the generic definition given by the above preamble, is substantially characterized in that the device comprises a duct for conveying cycle gas under pressure, comprising a first end which is connected to a portion of the circuit in which the cycle gas is at a pressure higher than the minimal pressure, and a second end which communicates with the interior of the junction box, the junction box comprising a passage for communication with the interior of the casing, the fluid circuit comprising a cycle gas return duct, comprising a first end which communicates with the interior of the casing, and a second end which is connected to the circuit, the conveying duct, the passage and the return duct being configured to collect a fraction of the cycle gas which flows in the circuit, in order to make it circulate in the junction box so as to cool the box before returning to the circuit.

In addition, embodiments of the invention can comprise one or a plurality of the following characteristics:

- the first end of the conveying duct is connected to the circuit downstream from an outlet of a drive unit;
- the second end of the conveying duct opens into the casing and/or into the junction box;
- the first end of the return duct opens into the casing and/or into the junction box;
- the second end of the return duct is connected to the circuit upstream from an inlet of a drive unit;
- the device comprises a unit for regulation of the flow of fluid circulating in the conveying duct;
- the flow regulation unit comprises at least one from among: a valve, a calibrated orifice;
- the fluid circuit comprises a unit for cooling the flow of fluid, such as a heat exchanger positioned between an outlet of the circulation unit and the first end of the bypass duct;
- the passage and a first end of the return duct are situated at opposite ends of the junction box;
- the electrical circuitry which passes in the junction box comprises an assembly of electrical cables, the passage comprising an orifice for communication between the interior of the junction box and the interior of the casing, and through which the assembly of cables extends;
- the device comprises at least two distinct casings each containing an electrical machine to drive respective drive units, each electrical machine being provided with a respective electrical junction box communicating with the casing via a passage, the device comprising at least two ducts for conveying cycle gas under pressure, each comprising a first end connected to a portion of the circuit in which the cycle gas is at a pressure higher than the minimal pressure, and a second end communicating with the interior of a corresponding junction box;
- the first end of a first duct for conveying to the casing of a first electrical machine is connected to the fluid circuit downstream from the outlet of a first drive unit, the device comprising a transfer duct having a first end connected to the casing of the first electrical machine, and a second end opening into the junction box of the second electrical machine, the device comprising a return duct comprising a first end communicating with the second casing, and a second end connected to the circuit, the first conveying duct, the transfer duct, the passages and the return duct being configured to collect a fraction of the fluid flow flowing in the fluid circuit, in order to make it circulate in series in the junction boxes for the purpose of cooling the boxes before returning to the circuit;

the device comprises two conveying ducts having first ends which are connected to the circuit, and second ends communicating in parallel respectively with the two junction boxes and/or with the two casings;

the first ends of the two conveying ducts are connected to a single portion of the circuit.

The invention also concerns an installation for refrigeration and/or liquefying, comprising a refrigerator comprising a work circuit of a cycle gas, said circuit comprising, positioned in series, at least one stage for compression of the cycle gas, at least one unit for cooling of the cycle gas, at least one stage for expansion of the cycle gas, and at least one unit for heating of the cycle gas, the installation comprising a circulation gas according to any one of the characteristics above or below, wherein the drive unit comprises a compressor wheel forming a compression stage.

According to other possible distinguishing features:

the at least one unit for heating the cycle gas comprises a heat exchanger which is in thermal exchange with an element to be cooled, for example a flow of fluid;

the cycle gas comprises at least one from among: nitrogen, helium, hydrogen, argon, neon.

The invention also concerns a method for cooling an electrical junction box of an electric motor of a circulation device according to any one of the characteristics above or below or of an aforementioned installation, the method comprising a step of collecting a fraction of the fluid flowing in the fluid circuit, and putting this fraction of fluid into circulation in the junction box in order to cool the box, then a step of returning this fraction of fluid to the fluid circuit.

According to other possible distinguishing features:

The invention can also concern any alternative device or method comprising any combination of the characteristics above or below within the context of the claims.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

Other particular features and advantages will become apparent from reading the following description, provided with reference to the figures, in which:

FIG. 1 represents a schematic partial view illustrating a first example of a structure and possible operation of a device according to the invention;

FIG. 2 represents a schematic partial view illustrating a first example of a structure and possible operation of an installation according to the invention;

FIG. 3 represents a schematic partial view illustrating a second example of a structure and possible operation of an installation according to the invention;

FIG. 4 represents a schematic partial view in cross-section illustrating a first possible example of a detail of the junction box of the device or the installation according to the invention;

FIG. 5 represents a schematic partial view illustrating a second example of a structure and possible operation of a device according to the invention;

FIG. 6 represents a schematic partial view in cross-section illustrating a second possible example of a detail of the junction box of the device or the installation according to the invention;

FIG. 7 represents a schematic partial view in cross-section illustrating a third possible example of a detail of the junction box of the device or the installation according to the invention;

FIG. 8 represents a schematic partial view illustrating a third example of a structure and possible operation of an installation according to the invention.

DETAILED DESCRIPTION OF THE INVENTION

The device 1 for circulation of fluid illustrated by way of example in [FIG. 1] is preferably designed to be used in a refrigerator or cryogenic liquefier using a gas cycle. It will be appreciated that it could be used in other devices, such as a compression apparatus for example (in particular a non-cryogenic compressor).

The device 1 comprises a casing 2 which is sealed against the exterior of the device, and contains an electric motor 3, and at least one fluid drive unit 4 such as a compressor wheel which is fitted on a shaft 20 rotated by the electric motor 3, in order to form a cycle gas compression stage. The device 1 comprises a cycle gas circuit 5, comprising a downstream portion which is connected to an outlet of the drive unit 4 (outlet of the compression stage for example).

The device 1 comprises an electrical junction box 6 which is sealed relative to the exterior of the device, and in which electrical circuitry 8 passes. The junction box 6 is for example fitted on, or is integral with, the casing 2. For example, the junction box 6 is a box which is distinct from the casing 2, and communicates with the casing 2 via one or a plurality of passages or orifices. Similarly, at least part of the walls delimiting the junction box 8 can be in common, and combined with, at least part of a wall delimiting the casing 2.

The electrical circuitry 8 has a first end which is connected to the motor 3 (via a passage 9 through the box 6 and casing 2 or the like), and a second end which is connected to at least one electrical connector 7 opening on the exterior of the junction box 6. The electrical connector 7 is typically situated on the exterior of the casing 2 (and the device 1 if applicable).

As illustrated, the electrical circuitry 8 which passes in the junction box 6 can comprise an assembly of electrical cables. These cables can be connected to at least one connector 7, for example of the male type, which is fitted and projects for example on a wall or cover which closes the box 6 in a sealed manner (for example via a screw or bolt securing assembly and a sealing system cf. [FIG. 4]). For example, the connector(s) 7 is/are surrounded by a protective wall. The connector 7 thus forms an electrical junction which is on the exterior of the device 1, and in particular at ambient temperature, whereas the interior of the junction box 6 contains an atmosphere which is protected against the exterior, for example a gaseous volume with a determined composition and pressure.

The circuit 5 comprises a conveying duct 15 comprising a first end which is connected to a portion of the circuit 5 in which the working gas is not at its minimal pressure in the circuit 5 (typically downstream from a compression stage) and a second end which opens into the junction box 6.

The junction box 6 also comprises at least one passage 9 for communication with the interior of the casing 2 of the motor. If applicable, all or part of the electrical circuitry (cables, etc.) can pass via this passage 9, as schematized in [FIG. 4].

The circuit 5 comprises a return duct 25 comprising a first end which communicates with the interior of the casing 2, and a second end which is connected to the circuit 5, in a portion of the circuit in which the working gas is not at its maximal pressure, in particular at a pressure which is equal to, or greater than, the minimal pressure, for example upstream from the compression unit 4. The conveying duct 15, the passage 9 and the return duct 25 are thus configured to collect a fraction of the flow of working gas under pressure flowing in the circuit 5, in order to make it circulate in the junction box 6, so as to cool the box before returning into the circuit 5.

This makes it possible to cool the electrical supply enclosure (junction box 6) of a motor 3 or of a turbomachine, for example by means of a cycle gas flow under pressure put into circulation in the hermetic (or semi-hermetic) part of a junction box 6. This flow of fluid can be made possible by adding and extracting gas (or liquid) through piping, machined cavities and/or cable passages for example.

In particular, as illustrated in [FIG. 4], the passage 9 can comprise an orifice for communication between the interior of the junction box 6 and the interior of the casing 2, and through which the cable assembly passes.

Preferably, the passage 9 and the first end of the return duct 25 which opens into the junction box 6 are situated at opposite ends of the junction box 6, in order thus to assist agitation and efficient cooling by the cycle fluid flow.

This flow of cooling fluid can be driven by a loss of dynamic load between the point of injection and discharge of the motor or of the piping connected thereto.

As illustrated, preferably, the circuit 5 can comprise a unit 11 for regulation of the flow of fluid circulating in the branching duct 15, for example a valve, a calibrated orifice, or any other appropriate unit (controlled valve for example). The flow regulation unit 11 can be positioned on the conveying duct 15.

As illustrated, the circuit 5 can advantageously comprise a unit 12 for cooling the flow of fluid, such as a heat exchanger, preferably positioned between the circulation unit 4 (compression stage) and the first end of the conveying duct 15. This cooling unit 12 can be a cooling heat exchanger conventionally positioned at the outlet of a compression stage in order to cool the flow of compressed cycle gas (by exchange of heat with a heat-exchange medium, such as water, or another fluid for example).

The fluid circulation device 1 illustrated by way of example in [FIG. 1] is a motor-turbocharger comprising a compression wheel and a turbine 16 fitted on the shaft 20 of the motor 3. It will be appreciated that this is simply a non-limiting example, since the invention could be applied to a simple motor-compressor (motor driving one or a plurality of compression wheels) or any other arrangement (one or a plurality of compression wheels and one or a plurality of turbines).

FIG. 2 describes an example of implementation in a refrigerator or liquefier producing cold power by subjecting a cycle gas to a thermodynamic cycle in a work circuit.

The work circuit 5 can comprise, positioned in series, at least one stage 4 for compression of the cycle gas, at least one unit 12, 14 for cooling of the cycle gas (heat exchanger (s) for example, at least one stage 16 for expansion of the cycle gas (turbine(s) or valve(s) for example) and at least one unit 17, 14 for heating of the cycle gas (heat exchanger (s) for example). The compression unit 4 (at least one stage) can comprise a circulation device 1 of the above-described type.

A heat exchanger 12 for cooling of the cycle gas at the outlet of the compression stage can assure cooling of the cycle gas which will be used to cool the junction box 6.

The cooling and heating of the cycle gas can be assured by at least one counter-current heat exchanger 14, which receives a flow of cycle gas at distinct temperatures in the cycle. At its coldest end in the cycle, the cycle gas can be heated by yielding its frigories by heat exchange with a unit to be cooled in a heat exchanger 17 (flow 13 of fluid to be cooled or to be liquefied for example).

The invention can be applied to a device (refrigerator or the like) comprising a plurality of motors 3 each having an electrical junction box 6. Some or all of the motors can comprise a respective cooling system of the type described above. As a variant or in combination, motors can share or pool all or part of the cooling system described above.

In the non-limiting example in [FIG. 3], the refrigeration/liquefaction installation 10 comprises two motors 3, and the corresponding two junction boxes 6 are cooled by the same cycle gas flow. In this example, the device comprises an expansion stage (a turbine 16).

More specifically, each motor 3 is provided with a respective electrical junction box 6 which communicates with the corresponding casing 2 via passage 9. The conveying duct 15 comprises a first end which is connected to the circuit 5, for example at a downstream portion of the drive unit 4 of a first motor 3 (for example at the outlet of the second cycle gas compression stage).

The device 1 comprises a transfer duct 35 with a first end connected to the casing 2 of the first motor 3, and a second end opening into the junction box 6 of the second motor 3 (of the first compression stage upstream in the cycle gas work circuit). As illustrated, the transfer duct 35 preferably comprises a unit 13 for cooling the flow of cycle fluid, such as a heat exchanger which is cooled by a heat exchange medium (water, air or the like), in order to cool the cycle gas before cooling the second junction box 6.

The return duct 25 comprises a first end which communicates with the interior of the casing 2 of the second motor 3, and a second end which is connected to a portion of the fluid circuit 5, for example upstream from the first compression stage. As schematized in a broken line, the return duct 25 can optionally comprise a unit 25 for cooling of the cycle gas flow (heat exchanger or the like) before it is re-injected upstream from a compression stage.

Thus, the conveying duct 15, the transfer duct 35, the passages 9 and the return duct 25 make it possible to collect a fraction of the compressed cycle gas, in order to make it circulate in series in the junction boxes 6, so as to cool these boxes before returning to the circuit 5.

The example in [FIG. 3] has two stages for compression in series of cycle gas, with a cooling exchanger 12 at the outlet of each compression stage. Also, the device illustrated has a single expansion stage (a turbine 16).

It will be appreciated that the invention can be applied to any other type of installation architecture, and in particular to any type of refrigerator or cryogenic liquefier (typically bringing a working gas to a temperature lower than −150° C.) with one or a plurality of compression stages and expansion stages, with a different number of motors.

The variant of [FIG. 8] is distinguished from that of [FIG. 3] only in that the first end of the conveying duct 15 is connected between the two compressors 4 in series, for example downstream from the cooling exchanger 12.

In addition, the invention can be applied to a device 1 wherein the motor 3 (or at least one of the motors) is replaced by any other electrical machine, for example an alternator. In this case, the drive unit 4 can comprise a turbine. The turbine(s) 16 can be designed for recuperation of mechanical work which is intended to produce electric power.

Similarly, the first end of the conveying duct can be connected downstream from another unit of the circuit 5, in particular downstream from a unit 4 different from that which is driven by, or coupled to, the electrical machine 3, the junction box 6 of which is to be cooled.

Typically, the first end of the conveying duct(s) 15 is preferably connected to a point of the circuit where the pressure of the cycle gas is higher than the lowest pressure of the cycle gas in the circuit 5. In fact, the cycle gas is subjected in the circuit 5 to thermodynamic transformation (in particular a compression/expansion cycle), between at least two states at low (minimal) and high (maximal) pressures. The cycle gas which is collected in the circuit 5 in order to cool at least one junction box 6 is preferably at a pressure higher than its minimal pressure in the circuit 5.

For example, this cycle gas is collected in the circuit 5 downstream from at least one of the compressors 4 of the circuit 5.

For example, this cycle gas is collected downstream from the compressor 4, which is coupled in rotation on the shaft of the motor 3, the junction box 6 of which is to be cooled. However, this first end of the conveying duct 15 can be connected to the outlet of another compressor 4 (or another unit 4) which is coupled to another motor 3 or electrical machine of the device 1.

Similarly, the second end of the return duct 25 is preferably connected to a portion of the circuit in which the pressure of the cycle gas is relatively low (lower than the maximal pressure), for example at the intake of one of the compressors 4. For example, the return duct 25 is connected to the intake of the compressor 4 which is coupled to (driven by) the motor 4, the junction box 6 of which is cooled by the cycle gas.

In the variant illustrated in [FIG. 5], the device comprises two motors 3, each driving a compressor 4. One of the motors 3 is also coupled to a turbine 16 via the same shaft which drives the compressor.

Conventionally, each motor 3 can comprise a stator 32 and a rotor 31 coupled to a rotary shaft which bears the wheels (compressor(s) 4 and turbine(s) 16).

In this example, two conveying ducts 15 have a first end (which is common in this example) connected downstream from a first one 4 of the two compressors 4 in series, for example downstream from an exchanger 12 for cooling the compressed cycle gas. The second ends of the two conveying ducts 15 are connected in parallel respectively to the two casings 2. The cycle gas under pressure then passes into the junction boxes 6 via the passages 9, and exits from the box 6 and the casing 2 via return ducts 25. The two return ducts 25 can be connected once more to the inlet of a single compressor 4, for example to the first one 4 of the two compressors in series. Thus, the cycle gas under pressure used for cooling of the junction box 6 can previously pass into the corresponding casing 2 before passing into the junction box 6.

As illustrated, the device 1 can also comprise a duct 21 which diverts part of this cycle gas under pressure to a labyrinth system 18 at bearings of the shaft of the motor 3. Typically, this labyrinth system 18 is designed to separate the gaseous atmosphere in the casing 2 from the exterior. In other words, a duct 21 can be connected in parallel to the duct 15 for conveying to a labyrinth (or any bearing system). This duct 21 (just like the conveying duct 15) preferably comprises a valve system 22, which permits opening or closure independently, as required.

FIG. 6 illustrates that the second end of the conveying duct 15 can open into the casing 2 and into the junction box 6. Most of the flow (for example approximately 90% of the flow) is supplied to the casing 2 for cooling thereof), and the remainder of the flow is supplied to the interior of the junction box 6. The flow of cycle gas which cools the junction box 6 reaches the casing 2 via a portion of the return duct 25 which can contain the electrical cables (forming the passage 9). The flows of cooling cycle gas are symbolized by curved arrows.

In the embodiment in [FIG. 7], the second end of the conveying duct 15 opens into the casing 2, the flow of the cycle gas then passes into the junction box 6 via at least one passage 9, and then goes into the volume 2 of the casing 2. Thus, the injected cycle gas passes firstly into the motor casing 2, and then reaches the junction box 6, passing for example in the same location as the electric cables.

Thus, the cycle gas under pressure can be collected by the first end of at least one conveying duct 15 at any appropriate location of the circuit 5, in order to be brought to a junction box 6 directly, or via a casing 2, or the like.

The invention makes it possible to provide compact junction boxes 6, while assuring efficient cooling thereof.

In the case of applications which use frequencies of 100 Hz or more, the electric currents preferably circulate on the surface of the conductive materials. The device is particularly suitable for cooling elements with skin effects of this type, while reducing the temperature of the surfaces.

In the example represented, a single electrical connector 7 is represented, but the invention could be applied to junction boxes 6 comprising a plurality of connections or spark plugs, according to the number of phases of the electric motor and connections or spark plugs necessary to supply power to the electric motor.

The efficiency of the cooling also makes possible a decrease of the cross-section of the cables and other electrical units in the junction box 6.

The invention thus permits improvement of the thermal performance and the resistance to pressure of the electrical junction to a motor.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A fluid circulation device for a refrigerator or cryogenic liquefier, the fluid circulation device comprising:

a first casing which is sealed against an exterior of the device, and contains a first electrical machine such as an electric motor or an alternator;

a fluid circuit which subjects a cycle gas to a thermodynamic change between a first pressure and a second pressure when the device is operating, wherein the first pressure is lower than the second pressure;

a first drive unit configured to drive the cycle gas in the fluid circuit, said first drive unit being coupled in rotation to the first electrical machine;

an electrical junction box which is sealed against the exterior of the device, and in which there passes electrical circuitry electrically connecting the first electrical machine and to at least one electrical connector wherein the at least one electrical connector opens onto an exterior of the junction box, and is situated on an exterior of the casing;

a first conveying duct configured to convey the cycle gas under pressure, the first conveying duct providing a conveying connection to a portion of the fluid circuit in which the cycle gas is at a pressure higher than the first pressure and an interior of the junction box, wherein the junction box comprises a passage for communication with an interior of the casing, wherein the fluid circuit comprises a cycle gas return duct, which is configured to fluidly communicate with the interior of the casing, and the fluid circuit, wherein the first conveying duct, the passage and the cycle gas return duct are configured to collect a fraction of the cycle gas which flows in the fluid circuit, in order to make the fraction of the cycle gas circulate in the junction box so as to cool the box before returning to the fluid circuit.

2. The device as claimed claim 1, wherein the first conveying duct that is connected to the portion of the fluid circuit is connected at a location that is downstream from an outlet of the first drive unit or a second drive unit.

3. The device as claimed claim 1, wherein the first conveying duct is further configured to provide fluid communication between the portion of the fluid circuit to the interior of the casing.

4. The device as claimed claim 1, wherein the cycle gas return duct is further configured to provide fluid communication between an interior of the junction box.

5. The device as claimed claim 1, wherein the cycle gas return duct is connected to the fluid circuit upstream from an inlet of the first drive unit or a second drive unit.

6. The device as claimed claim 1, further comprising a flow regulation unit for regulation of the flow of a fluid circulating in the first conveying duct.

7. The device as claimed claim 6, wherein the flow regulation unit is selected from the group consisting of a valve, a calibrated orifice, and combinations thereof.

8. The device as claimed claim 1, wherein the fluid circuit comprises a cooling unit configured to cool the flow of a fluid, wherein the cooling unit is positioned between an outlet of the first drive unit and the first conveying duct.

9. The device as claimed claim 1, wherein the passage and the cycle gas return duct are situated at opposite ends of the junction box.

10. The device as claimed claim 1, wherein the electrical circuitry which passes in the junction box comprises an assembly of electrical cables, and in that the passage comprises an orifice for communication between the interior of the junction box and the interior of the casing, and through which the assembly of cables extends.

11. The device as claimed claim 1, further comprising a second distinct casing containing a second electrical machine to drive a second drive unit, the second electrical machine being provided with a second electrical junction box communicating with the casing via a second passage, the device comprising a second conveying duct for conveying the cycle gas under pressure, wherein the second conveying duct provides a second conveying connection to a second portion of the fluid circuit in which the cycle gas is at a pressure higher than the first pressure and with the interior of a corresponding junction box.

12. The device as claimed claim 11, wherein the first conveying duct is connected to the fluid circuit downstream from the outlet of the first drive unit, the device comprising a transfer duct that is configured to provide fluid communication between the casing of the first electrical machine and the second junction box of the second electrical machine, the device comprising a second cycle gas return duct that is configured to allow fluid communication between the second casing and the fluid circuit, the first conveying duct, the transfer duct, the passages and the return duct being configured to collect a fraction of the fluid flow flowing in the fluid circuit, in order to make the fraction of the fluid flow circulate in series in the junction boxes for the purpose of cooling the boxes before returning to the fluid circuit.

13. The device as claimed claim 11, wherein the first conveying duct and the second conveying duct fluidly connect the fluid circuit in parallel to the respective junction boxes and/or to the respective casings.

14. The device as claimed claim 13, wherein the first portion of the fluid circuit that is connected to the first conveying duct and the second portion of the fluid circuit that is connected to the second conveying duct are the same portion of the fluid circuit.

15. An installation for providing cooling, the installation comprising a refrigerator comprising a fluid circuit of a cycle gas, said fluid circuit comprising, positioned in series, at least one stage for compression of the cycle gas, a cooling unit configured to cool the cycle gas, an expansion stage configured to expand the cycle gas, and a heating unit configured to heat the cycle gas, wherein the installation comprises the fluid circulation device as claimed in claim 1, wherein the first drive unit comprises a compressor wheel forming the at least one stage for compression.

16. The installation as claimed in claim 15, wherein the at least one unit for heating of the cycle gas comprises a heat exchanger, which is in thermal exchange with an element to be cooled.

17. The installation as claimed in claim 15, wherein the cycle gas is selected from the group consisting of: nitrogen, helium, hydrogen, argon, neon, and combinations thereof.

18. A method for cooling the electrical junction box of the electric motor of the fluid circulation device as claimed in claim 1, the method comprising the steps of:

collecting a fraction of a fluid flow flowing in the fluid circuit;

putting said fraction of the fluid into circulation in the junction box in order to cool the box; and returning said fraction of the fluid to the fluid circuit.

* * * * *